US005685428A

United States Patent [19]

Herbers et al.

[11] Patent Number: 5,685,428

[45] Date of Patent: Nov. 11, 1997

[54] UNITARY PACKAGE

[75] Inventors: Dennis Michael Herbers, Fairfield; John Paul Erspamer, Cincinnati; William Paul Dirksing, Cleves, all of Ohio

[73] Assignee: The Procter & Gamble Company, Cincinnati, Ohio

[21] Appl. No.: 616,545

[22] Filed: Mar. 15, 1996

[51] Int. Cl.[6] ..... B65D 85/28

[52] U.S. Cl. ..... 206/391; 206/432; 206/497

[58] Field of Search ..... 206/192, 391, 206/428, 432, 497; 53/154, 156, 443, 543

[56] References Cited

U.S. PATENT DOCUMENTS

| | | | |
|---|---|---|---|
| 2,888,132 | 5/1959 | Guyer | 206/56 |
| 3,047,140 | 7/1962 | Robins | 206/56 |
| 3,303,630 | 2/1967 | Harm | 53/28 |
| 3,344,577 | 10/1967 | Harm | 53/39 |
| 3,415,358 | 12/1968 | Faller | 206/46 |
| 3,460,671 | 8/1969 | Harm | 206/65 |
| 3,515,272 | 6/1970 | Von Gal | 206/192 |
| 3,540,582 | 11/1970 | Wood | 206/192 |
| 4,066,166 | 1/1978 | Klygis | 206/427 |
| 4,077,516 | 3/1978 | Duerr | 206/432 |
| 4,382,506 | 5/1983 | Chaussadas | 206/200 |
| 4,415,082 | 11/1983 | Martin | 206/431 |
| 4,474,293 | 10/1984 | Osborne | 206/497 |
| 4,553,668 | 11/1985 | James et al. | 206/391 |
| 4,596,330 | 6/1986 | Benno | 206/427 |
| 4,641,488 | 2/1987 | Garr | 53/442 |
| 4,880,115 | 11/1989 | Chaussadas | 206/427 |
| 4,901,505 | 2/1990 | Williams, Jr. | 53/412 |
| 4,919,265 | 4/1990 | Lems et al. | 206/432 |
| 4,920,731 | 5/1990 | Rimondi et al. | 53/556 |
| 4,928,817 | 5/1990 | Focke | 206/256 |
| 4,932,528 | 6/1990 | Benno | 206/432 |
| 4,955,184 | 9/1990 | Francioni | 53/448 |
| 5,007,550 | 4/1991 | Avot | 220/8 |
| 5,023,143 | 6/1991 | Nelson | 428/516 |
| 5,048,687 | 9/1991 | Suzuki et al. | 206/497 |
| 5,059,481 | 10/1991 | Lustig et al. | 428/39.9 |
| 5,067,612 | 11/1991 | Tsuchiya et al. | 206/497 |
| 5,082,744 | 1/1992 | Akao et al. | 428/522 |
| 5,097,955 | 3/1992 | Kluter et al. | 206/497 |
| 5,154,288 | 10/1992 | Gloyer | 206/427 |
| 5,158,177 | 10/1992 | Negelen et al. | 206/147 |
| 5,188,226 | 2/1993 | Platt | 206/153 |
| 5,229,180 | 7/1993 | Littmann | 428/43 |
| 5,299,733 | 4/1994 | Werth | 229/120.011 |
| 5,300,353 | 4/1994 | Yoshimura et al. | 428/213 |
| 5,328,743 | 7/1994 | Wynne et al. | 428/105 |
| 5,378,066 | 1/1995 | Wade | 383/205 |
| 5,452,798 | 9/1995 | Kraft | 206/192 |

*Primary Examiner*—David T. Fidei

*Attorney, Agent, or Firm*—Larry L. Huston; E. Kelly Linman; Jacobus C. Rasser

[57] ABSTRACT

A unitary package comprising a plurality of individual inner packages juxtaposed with each other at one or more interfaces. At least some inner packages are wrapped in a wrapper and are peripherally disposed along at least first and second outside walls of the unitary package, defining these first and second outside walls. A first sheet of material having at least one line of weakness is juxtaposed with the first outside wall and interconnects all peripherally disposed inner packages by engaging each of them. Preferably, a second sheet of material is juxtaposed with the second outside wall interconnecting all peripherally disposed inner packages. Preferably, both sheets of material have a self-registering pattern of a plurality of lines of weakness running in both mutually perpendicular directions and comparatively closely spaced such that there is a high probability that at least one of these lines is positioned at the interface of the individual inner packages. The unitary package can be carried as an integral unit and disassembled fully or partially along the lines of weakness.

22 Claims, 8 Drawing Sheets

UNITARY PACKAGE

FIELD OF THE INVENTION

The present invention relates to a means for retaining a plurality of products in a multi-unit package and to a method for forming such a package. Particularly, the present invention relates to a unitary package comprised of a plurality of inner packages containing products that are normally used one at a time, such as paper towel and bathroom tissue.

BACKGROUND OF THE INVENTION

Paper towel, facial tissue, and bathroom tissue products are often sold in multi-unit packages. Purchasing trends in the paper products field have included lower purchase frequencies with larger quantities of paper products per purchase. Manufacturers have responded by increasing the number of discrete units of towel or tissue products contained within a single package. Frequently, consumers keep these products, such as multi-unit paper towels, bath tissue, and facial tissue, in places besides the point of use in the kitchen or bathroom. Consumers store the multi-unit packages in remote places like basements and closets.

Because these products are susceptible to moisture and are normally used one at a time, many consumers store the products in an outer wrap until they get down to the last few items. This keeps the stored products protected and organized.

However, when a consumer gets down to the last few items, the outer wrap usually becomes less neat and does not serve a useful purpose, so the consumer tends to remove the remaining packages and discard the outer wrap. Thus, hygienic concerns, susceptibility of the products to the effects of moisture and convenience of the consumer dictate that the discrete units of products contained in the multi-unit package be individually wrapped. The individual wrapper is usually a thin plastic film.

One of the ways these multi-unit packages are packaged is by putting the individually wrapped unit of inner package of products in an outer wrap, often a larger pre-made plastic film bag. There are several manufacturing processes for forming such a multi-unit package containing individually wrapped inner products. In all of these processes, an outer wrap completely encases the inner units, forming, in essence, a double-wrapped package. An example of this double wrapping is shown in U.S. Pat. No. 4,553,668, issued Nov. 19, 1985, to Robert C. James et al, assigned to Hayssen Manufacturing Company, which is incorporated herein by reference. Double wrapping adds to the packaging, storing and handling costs of the multi-unit package.

In addition to packaging and handling costs, the relatively large outer wrap required to form a multi-unit package must eventually be disposed. Because plastic films usually are not biodegradable and recycling facilities are limited, environmental concerns dictate that as little as possible of the packaging plastic film should be used.

One way to decrease the quantity of outer packaging material used for the outer wrap is to assemble the individual unit packages in an array and hold them together by bands. The use of an encircling band girdling a multipack of containers, such as cans and jars, is disclosed in U.S. Pat. No. 5,154,288 issued October, 1992, to Gloyer, which is incorporated herein by reference. This method of packaging does not require double wrapping of individual packages, but has a disadvantage in that once the bands are removed, it is difficult to keep the packages neatly organized. The consumer has to remove the bands every time he or she desires to take out an individual package and then apply the bands back to the array, if he or she wants to keep the arrangement neatly organized. In addition, when applied to easily compressible articles, such as rolls of paper, the bands have the tendency to slide off or fall down from the multi-unit packages.

Another disadvantage of both double-wrap packaging and band packaging is that neither allows the consumer to easily divide a multi-unit package into two or more smaller sub-packages. The consumer may wish to separately store each sub-package as a separate unit without any additional packaging.

U.S. Pat. 4,415,082, issued Nov. 15, 1983 to Martin and assigned to The Mead Corporation, is an example of a multi-unit package accommodating a plurality of detachable primary parallelepiped containers in such a way that each detached container is left with a part of the wrapper. The invention provides for a tear-away strip to facilitate opening of the package and score lines to detach the primary containers. This invention, however, is oriented to forming a multi-unit package comprised of parallelepiped containers and does not provide for a multi-unit package comprising compressed inner packages, such as rolls of toilet paper and paper towel.

Accordingly, it is an object of the present invention to overcome the prior art disadvantages of packaging of the multi-unit packages of products, such as paper towel and bathroom tissue, thus providing improved convenience for the consumer.

It is another object of the present invention to provide a unitary package comprising a plurality of inner packages while reducing the amount and cost of the material needed for the packaging and, at the same time, decreasing the amount of packaging material to be disposed.

It is still another object of the present invention to provide a unitary package that can be easily divided into two or several smaller sub-packages by the consumer and offers convenient one-at-a-time easy removal of discrete inner packages from the unitary package while the balance of the unitary package remains together.

It is still another object of the present invention to provide such a unitary package that eliminates the need to register lines of weakness in the material of unitary package at the interface between individual inner packages for the purposes of dividing the unitary package into smaller sub-packages or removal of individual inner packages.

SUMMARY OF THE INVENTION

A unitary package of the present invention is comprised of a plurality of individual inner packages. Preferably, the inner packages have uniform size and configuration. The inner packages are juxtaposed with each other at one or more interfaces. At least some inner packages are peripherally disposed along at least first and second outside walls of the unitary package and may thereby define these walls. The inner packages peripherally disposed along at least first and second outside walls are wrapped in a wrapper. Each of the first and second outside walls has at least one projected interface formed by the inner packages. Mutually perpendicular maximum X and Y dimensions span the distance from at least a portion of the inner packages spaced furthest apart in the mutually perpendicular X and Y directions, respectively. A first sheet of material juxtaposed with and joined to the first outside wall spans at least the maximum X and Y dimensions of the first wall thereby engaging and interconnecting each of the peripherally disposed inner packages. At least one line of weakness is disposed on the first sheet. This line of weakness is juxtaposed with at least one of the interfaces formed at the first wall by and between the peripherally disposed inner packages. Preferably, a second sheet of material having at least one line of weakness and juxtaposed with the second outside wall spans at least the maximum X and Y dimensions of the second wall thereby engaging and interconnecting each of the peripherally disposed inner packages.

Preferably, the first and the second sheets have a self-registering pattern of a plurality of lines of weakness. The pattern comprises an array of a series of regularly spaced lines running in one or more directions. These lines are comparatively closely spaced such that there is a high probability that at least one of these lines is registered with the interface between the individual inner packages. As a result, the unitary package can be carried as an integral unit and fully or partially disassembled along the lines of weakness.

In its process aspect, the present invention comprises the steps of providing a plurality of inner packages, at least two of them being wrapped in wrappers; arranging the plurality of inner packages such that said inner packages are juxtaposed with each other at one or more interfaces, at least two of the inner packages being wrapped in a wrapper defining and being peripherally disposed along at least a first outside wall and a second outside wall of the unitary package; providing at least a first sheet of material having a self-registering pattern of a plurality of lines of weakness; disposing the first sheet of material on and joining it to the first outside wall thereby interconnecting said inner packages disposed at the first outside wall by engaging each of these peripherally disposed inner packages.

In its preferred embodiment, the process of forming the unitary package further comprises the steps of providing a second sheet of material having a self-registering pattern of a plurality of lines of weakness; disposing the second sheet of material on and joining it to the second outside wall thereby interconnecting the inner packages disposed at the second outside wall by engaging each of these peripherally disposed inner packages.

DETAILED DESCRIPTION OF THE INVENTION

Figure 1:
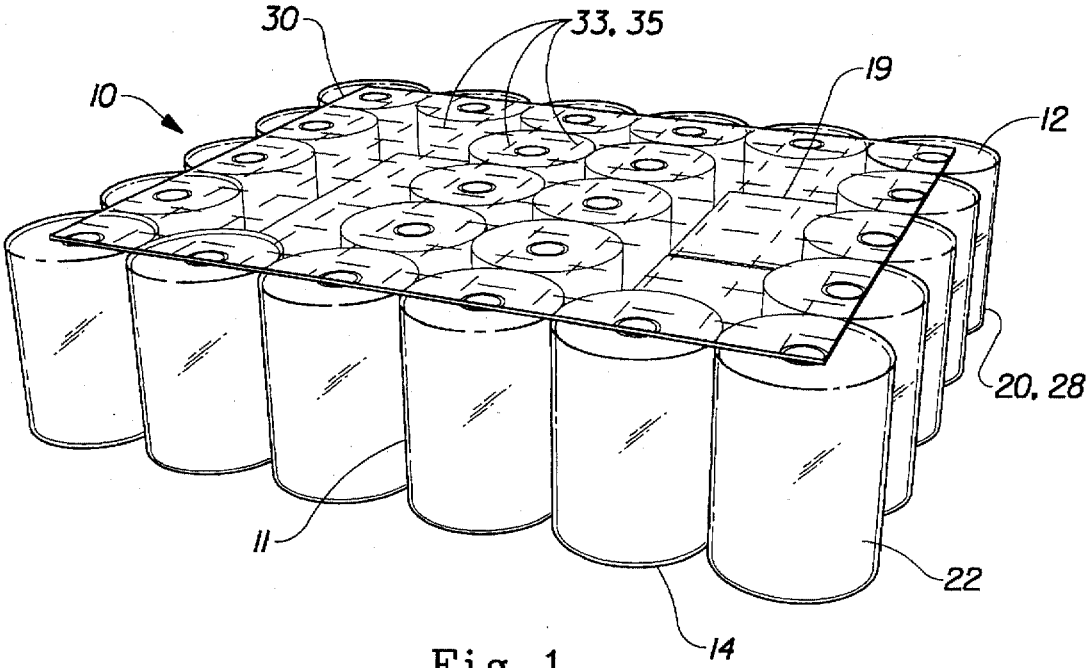
FIG. 1 is a perspective view of one exemplary unitary package comprising non-identical inner packages.

The present invention provides a unitary package comprising a plurality of individual inner packages. FIG. 1 illustrates the unitary package 10 and its various components. The unitary package 10 comprises a plurality of individual inner packages 19, 20 juxtaposed with each other at one or more interfaces 11. Some of the inner packages define a first outside wall 12 and a second outside wall 14 of the unitary package 10 and are peripherally disposed along the walls 12 and 14. The inner packages that do not define both the first and the second outside walls 12 and 14 are designated herein by the numerical 19.

Preferably, all peripherally disposed inner packages 20 defining the outside walls 12 and 14 are individually wrapped in wrappers 22. Each wrapper 22 may partially enclose each of the inner packages 20. Preferably, the wrapper 22 fully encloses each of the inner packages 20. Alternatively, the unitary package 10 may comprise both inner packages 20 fully wrapped in the wrapper 22 and inner packages 20 partially wrapped in the wrapper 22.

The wrapper 22 may comprise any suitable material including those selected from the group consisting of papers, polymeric films, nonwovens and laminate or composite structures of two or more of the aforementioned materials. It is to be understood that the wrapper 22 may comprise any material suitable for wrapping the inner packages 20. For example, a shrink wrap polyethylene film or a stretched polyethylene film can be used. Thermoplastic films or papers can also be utilized. The thickness of the wrapper material is preferably as small as possible, to reduce the cost of the wrapper 22, and at the same time, provide sufficient integrity. The wrapper 22 may be biodegradable and/or recyclable. Polyethylene films with a thickness from 0.4 mils to 1.5 mils are preferable for the wrappers 22.

Any method of wrapping the inner packages 19, 20 may be utilized in the present invention. A package for a plurality of cylindrical articles arranged with parallel axes and coplanar end surfaces is disclosed in U.S. Pat. No. 3,460,671, issued on Aug. 12, 1969 to Harm and incorporated herein by reference. Suitable devices for accomplishing wrapping a product in a wrapper 22 are, for example, Hayssen Ultraflow Wrapper machines, Model No. 140 and Model No. 250, manufactured by Hayssen Manufacturing Company, Green Bay, Wis.

One skilled in the art will recognize that inner packages 19, 20 comprising compressible items, such as toilet paper or paper towel, can be compressed and deformed into a generally flat shape in order to achieve compaction and reduce the cost of shipment and storage. For example, U.S.

Figure 7:
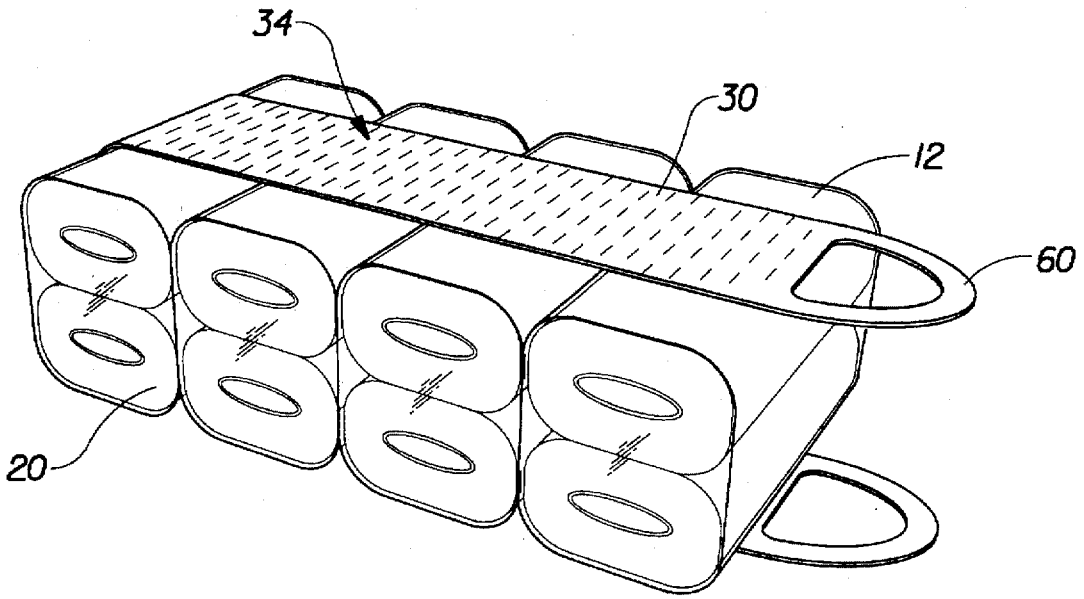
FIG. 7 is a perspective view of a unitary package, comprising compressed inner packages, in which the first sheet and the second sheet are integral.
Figure 7A:
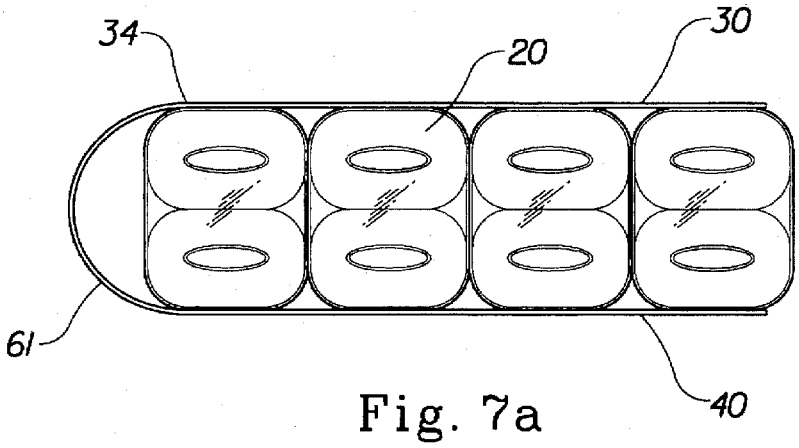
FIG. 7*a* is an another embodiment of the unitary package shown in FIG. 7.

Pat. No. 4,886,167, issued on Dec. 12, 1989 to Dearwester and U.S. Pat. No. 5,027,582, issued on Jul. 2, 1991 to Dearwester, both patents are assigned to The Procter & Gamble Company and incorporated herein by reference, describe a compact, low shipping volume paper product comprising a compression loaded, core-wound roll of paper and a compression element, and the method of making such a product. FIGS. 7 and 7*a* illustrate a unitary package 10 comprising inner packages 19, 20 in the form of compression loaded, core-wound rolls of paper.

Figure 2:
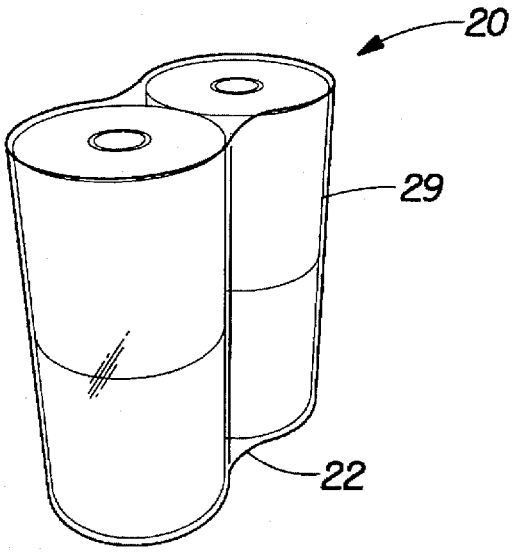
FIG. 2 is a perspective view of the inner package comprising four rolls of toilet paper.

The inner package 19, 20 may comprise a single item, for example, a single roll of paper towel 28 wrapped in the wrapper 22, as shown in FIG. 1. Alternatively, the inner package 20 may include several items. For example, the inner package 19, 20 may have four rolls of toilet tissue 29, as shown in FIG. 2. The four rolls 29 may be arranged in two side-by-side rows of two roils each, with two rolls arranged end-to-end in each row. All four rolls 29 may then be wrapped in a single wrapper 22, as shown in FIG. 2.

Figure 3:
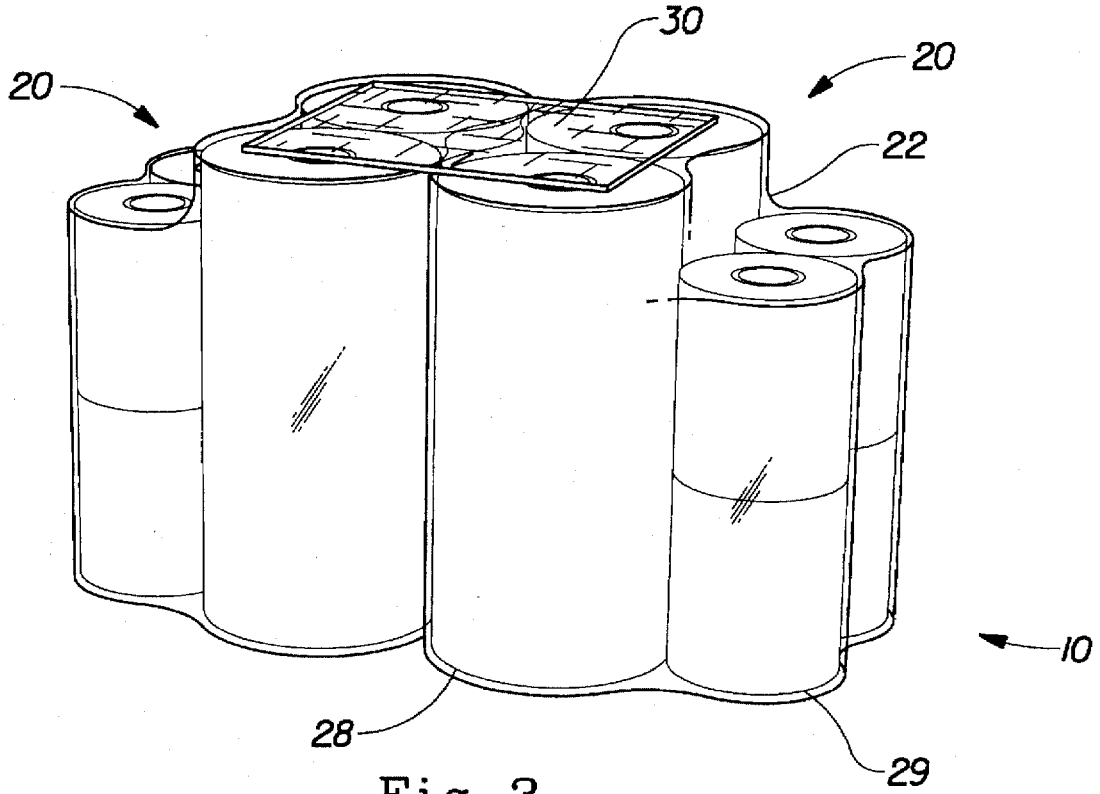
FIG. 3 is a perspective view of a unitary package comprising of two inner packages, each inner package comprising two rolls of towel paper and four rolls of toilet paper.

The inner packages 19, 20 may also comprise two or more non-identical items. For example, FIG. 3 shows the unitary package 10 comprised of two inner packages 20, each inner package 20 comprising two rolls of paper towel 28 and four rolls of toilet tissue 29 wrapped in the wrapper 22. In the preferred embodiment, the inner packages 20 are comprised of identical items, or identical sets of items, and therefore have a generally uniform size and shape. Preferably, the unitary package 10 comprises only the inner packages 20 wrapped in the wrappers 22 and arranged in abutting relationship with each other, and all the inner packages 20 define the first and the second outside walls 12 and 14.

Figure 1A:
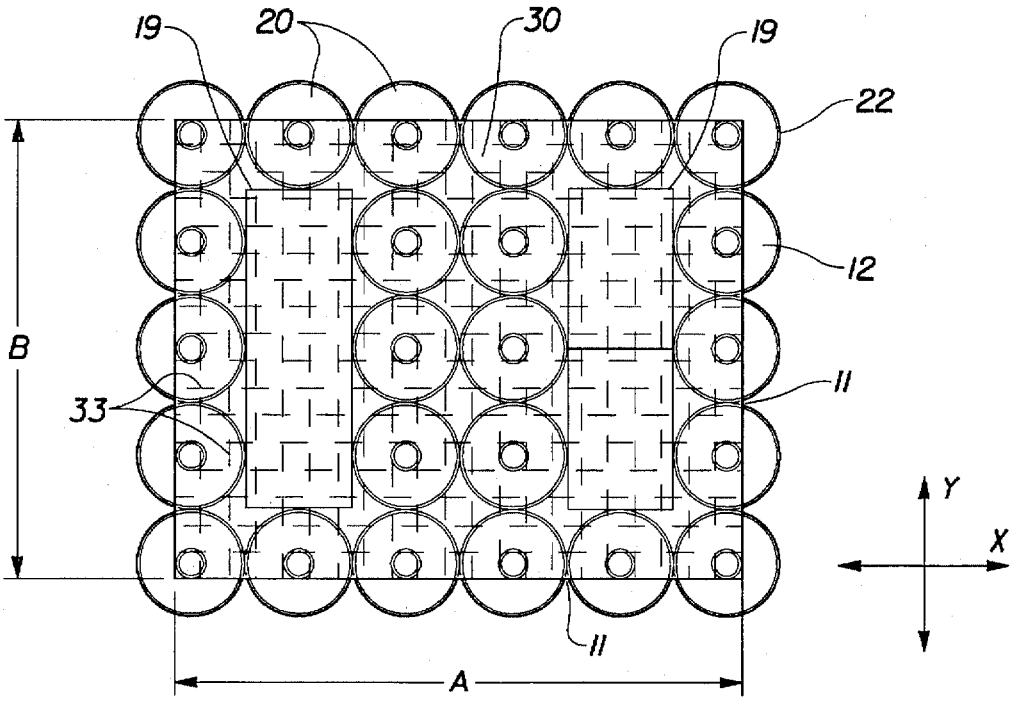
FIG. 1*a* is a top plan view of the unitary package shown in FIG. 1.

The unitary package 10 may also comprise inner packages 19 which do not define at least two outside Walls 12 and 14 and therefore are not peripherally disposed along at least two outside walls 12 and 14. For example,. FIG. 1*a* shows a unitary package 10 comprising twenty four rolls of towel paper (inner packages 20) and three boxes containing another product, for example, soap (inner packages 19). The inner packages 19, being "shorter" than and encircled on two sides by the inner packages 20, are incapable of being peripherally disposed along at least two outside walls 12 and 14. In the example shown in FIG. 1, the inner packages 19 need not be wrapped in the wrapper 22.

Figure 1B:
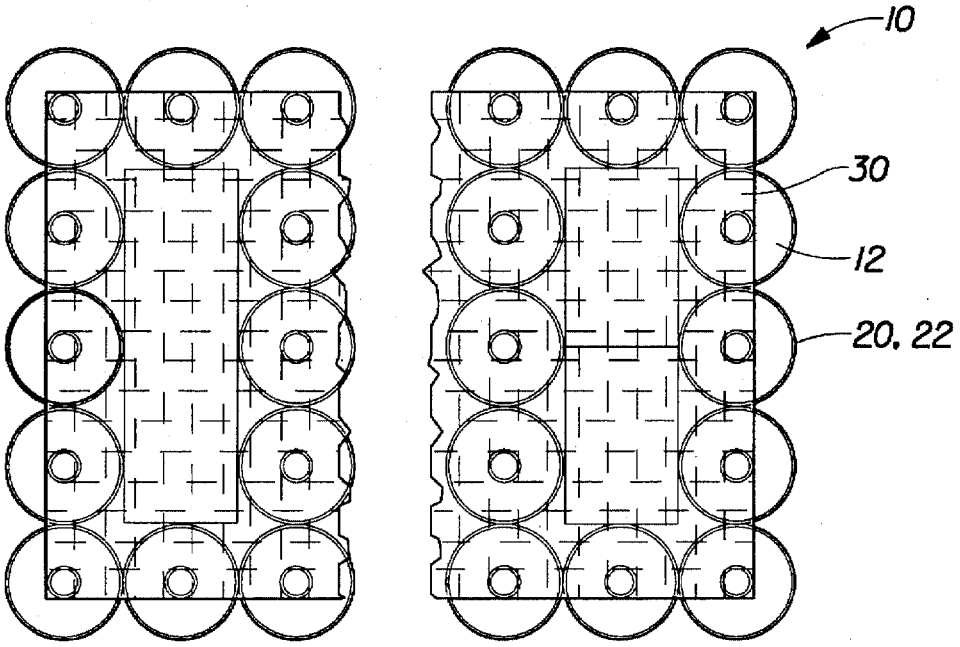
FIG. 1*b* is a top plan view of the partially disassembled unitary package shown in FIGS. 1 and 1*a*.

Referring now to FIGS. 1*a* and 1*b*, each of the outside walls 12 and 14 has mutually perpendicular maximum X and Y dimensions. As used herein, X and Y are orientations in a Cartesian coordinate system relating to the first wall 12 and the second wall 14 of the unitary package 10. In the Cartesian coordinate system described herein, each wall 12 and 14 of the unitary package 10 lies in a plane formed by the X and Y axes. It should be noted that, as used Herein, the X and Y directions are not common for the whole unitary package 10. That is to say, the first outside wall 12 lies in its own X-Y plane and has its own X and Y directions, the second outside wall 14 lies in its own X-Y plane and has its own X and Y directions, etc.

Referring to FIG. 1*a*, the maximum X dimension spans the distance from at least a portion of those inner packages 20 defining the first outside wall 12 that are spaced furthest apart in the X direction. The maximum Y dimension spans the distance from at least a portion of those inner packages 20 defining the first outside wall 12 that are spaced furthest apart in the Y direction. In FIG. 1*a*, the symbol "A" represents the maximum X dimension, and the symbol "B" represents the maximum Y dimension.

As FIG. 1 shows, the unitary package 10 of the present invention has a first sheet of material 30 juxtaposed with and joined to the first outside wall 12 having at least one interface 11. The first sheet of material 30 lies in the X-Y plane of the first wall 12 and has mutually perpendicular X and Y dimensions conforming to and spanning at least the maximum X and Y dimensions of the first wall 12. The first sheet 30 spans at least the maximum X and Y dimensions of the first wall 12 and engages those inner packages 20 which define the first wall 12 and are peripherally disposed along the first wall 12. That is to say, the first sheet of material 30 is joined to the first wall 12 by being joined to a plurality of and preferably each of, the inner packages 20 which define the first wall 12 and are peripherally disposed along the first wall 12. Because the maximum X and Y dimensions of the first outside wall 12 span the distance from at least a portion of the inner packages 20 spaced furthest apart in the mutually perpendicular X and Y directions, the first sheet of material 30 also spans at least the distance from at least a portion of those inner packages 20 which are spaced furthest apart in the mutually perpendicular X and Y directions. Thus, the first sheet of material 30 interconnects the inner packages 20 which define and are disposed along the first wall 12. As a result, the unitary package 10 becomes an integral unit and can be carried as such. It should be noted that the first sheet 30 may extend beyond the distance from at least a portion of the inner packages 20 which are spaced furthest apart find beyond the maximum X and/or Y dimensions of the first wall 12.

It will be understood the maximum X and Y dimensions shown in FIG. 1*a* could be decreased somewhat, provided at .least a portion of the peripheral inner packages 20 was intercepted by the first sheet of material 30. Functionally, the maximum X and Y dimensions are achieved when sufficient portions of the peripheral inner packages 20 are joined to the first sheet of material 30 to form a unitary package 10.

By the term "joined" it is meant that the first sheet 30 is either directly or indirectly permanently or releasably connected or bonded to the inner packages 20. There is a variety of methods of joining the first sheet of material 30 to the first outside wall 12. It can be accomplished, for example, by adhesive sealing, hook and loop fasteners, or by any other method that ensures permanent and durable joining. In the preferred embodiment of the invention, the first sheet 30 is joined to the wall 12 by heat-sealing.

Figure 1C:
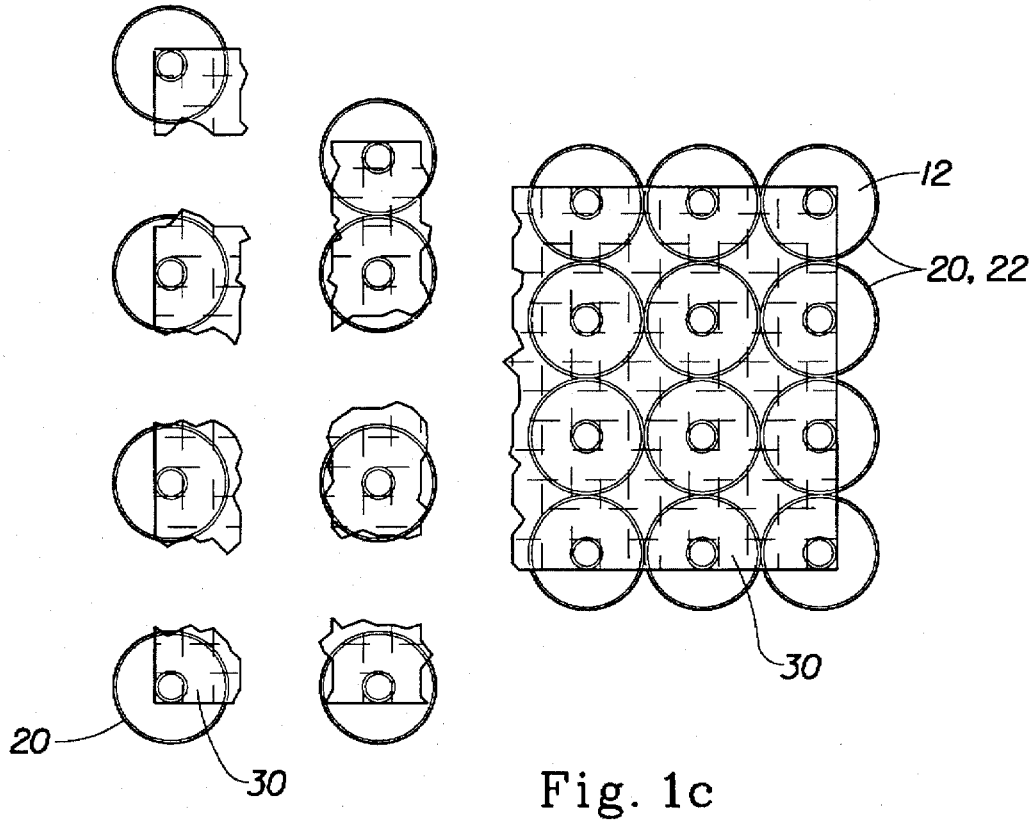
FIG. 1*c* is a top plan view of the partially disassembled unitary package of another embodiment comprising twenty identical inner packages.

The first sheet of material 30 joined to the first outside wall 12 has at least one line of weakness 33 disposed on the first sheet of material 30. This at least one line of weakness 33 is juxtaposed with at least one of the interfaces 11 formed by the adjacent inner packages 20. By tearing the sheet of material 30 along the line of weakness 33, a consumer can disassemble the unitary package 10 of the present invention and separate the individual inner packages 20, as illustrated in FIGS. 1*b* and 1*c*.

Figure 1D:
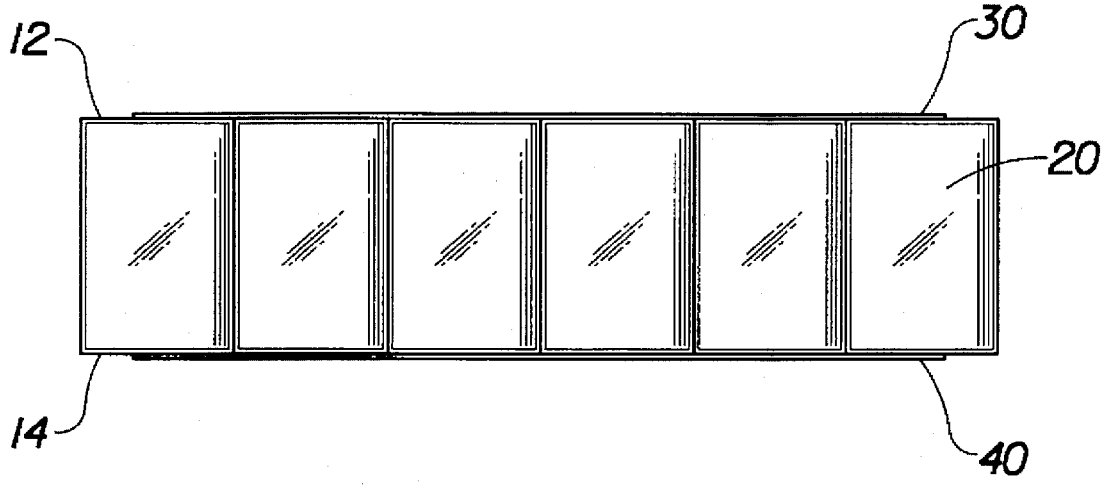
FIG. 1*d* is a schematic side elevational view of the unitary package shown in FIG. 1.

Referring now to FIG. 1*d*, the inner packages 20 of the preferred embodiment of the invention are interconnected by two sheets of a material, a first sheet 30 and a second sheet 40, joined to the first and second outside walls 12 and 14 respectively. Similarly to the first sheet 30, the second sheet 40 is juxtaposed with and joined to the second outside wall 14 having at least one interface 11 between adjacent inner packages 19, 20. The second sheet 40 lies in the X-Y plane of the second wall 14 and spans at least the maximum X and Y directions of the second outside wall 14, engaging and thereby interconnecting a plurality of and preferably each of the inner packages 20 that define the second wall 14 and are peripherally disposed at the second wall 14. Preferably, the first sheet 30 and the second sheet 40 engage the same inner packages 20.

Similar to the first sheet 30, the second sheet 40 joined to the second outside wall 14 has at least one line of weakness 33 disposed on the second sheet of material 40. This at least one line of weakness. 33 is juxtaposed with at least one of the interfaces 11 formed by the inner packages 20 at the second outside wall 14.

It should be noted that the X and Y dimensions of the first wall 12 may or may not be equal to the corresponding X and Y dimensions of the second wall 14. Consequently, the areas of the outside walls 12 and 14 may or may not be equal to each other. Therefore the dimensions and area of the first sheet 30 may or may not be equal to the dimensions and area of the second sheet 40.

The sheets 30 and 40 may comprise of any material selected from the group consisting of papers, polymeric films, nonwovens and laminate or composite structures of two or more of the aforementioned materials. The thickness of the sheets 30 and 40 is preferably as small as feasible, in order to reduce the cost of the wrapper material, and at the same time, to ensure their integrity necessary for their use. The sheets 30 and 40 may be comprised of a material which is biodegradable and/or recyclable. In the preferred embodiment of the present invention polyethylene films with a thickness from 0.7 mil to 2.0 mil are used as the material for the sheets 30 and 40. Preferably, the thickness of the first and the second sheets 30, 40 is greater than the thickness of the wrappers 22.

Although not preferable, the first and the second sheets 30, 40 may have a thickness equal to the thickness of the wrappers 22. In this case, the first and the second sheets 30, 40 are joined to the first and second walls 12, 14 respectively to have at least double thickness walls at regions of joining not coincident the interfaces 11. One skilled in the art will recognize that the term "at least double thickness" is meant to include triple thickness, quadruple thickness etc., depending on the method of wrapping the individual inner packages 19, 20 and the number of layers of the wrappers 22 at the regions of joining the sheets 30 and 40 to the inner packages 19, 20. If the thickness of the first and second sheets 30, 40 is greater than the thickness of the wrappers 22, the term "at least double thickness" is meant to refer to two or more layers of the wrapper 22 and the sheets 30, 40 at the regions of joining the sheets 30 and 40 to the wrappers 22.

As shown in FIGS. 1–1*d*, the sheets 30 and 40 of one exemplary embodiment of the invention have a configuration, generally rectangular, that conforms the overall shape of the outside walls 12 and 14. In the preferred embodiment of the present invention, the sheets 30 and 40 each have a self-registering pattern 35 of a plurality of lines of weakness 33, as illustrated in FIGS. 1–1*c*. By the term "self-registering pattern" it is meant that the pattern of lines of weakness 33 comprises an array of a series of lines of weakness 33 running in one or more directions and comparatively closely spaced such that there is a high probability that at least one of these lines of weakness 33 would be positioned at least one of the interfaces of the individual inner packages 20. Thus, there is no need to take a separate, affirmative step to register the sheets 30 and 40 on the walls 12 and 14 of the unitary package 10. The lines of weakness 33 that are not located at the interfaces 11 formed by the inner packages 20 may be heat sealed to the wrappers of the inner packages 19, 20, and therefore "closed" thereby becoming a part of the continuous joining of the sheets 30 and 40 with the walls 12 and 14. The consumer can tear the sheets 30 and 40 at the lines of weakness 33. FIGS. 1–1*c*, 6, 8 illustrate the self-registering patterns comprising various arrays of series of closely spaced lines of weakness 33 running in both mutually perpendicular X and Y directions of the sheets 30 and 40. As FIGS. 1*b* and 1*c* show, the unitary package 10 may be partially or fully disassembled along the lines of weakness 33.

The lines of weakness 33 can be formed by means known in the art including, for example, perforations in or chemical treatment of the material of the sheets 30 and 40. In the preferred embodiment of the invention illustrated in FIG. 4, the self-registering pattern of lines of weakness 33 comprises a plurality of perforations running in both cross-sectional directions X and Y of the sheets 12 and 14 and evenly extending from each other.

Figure 6:
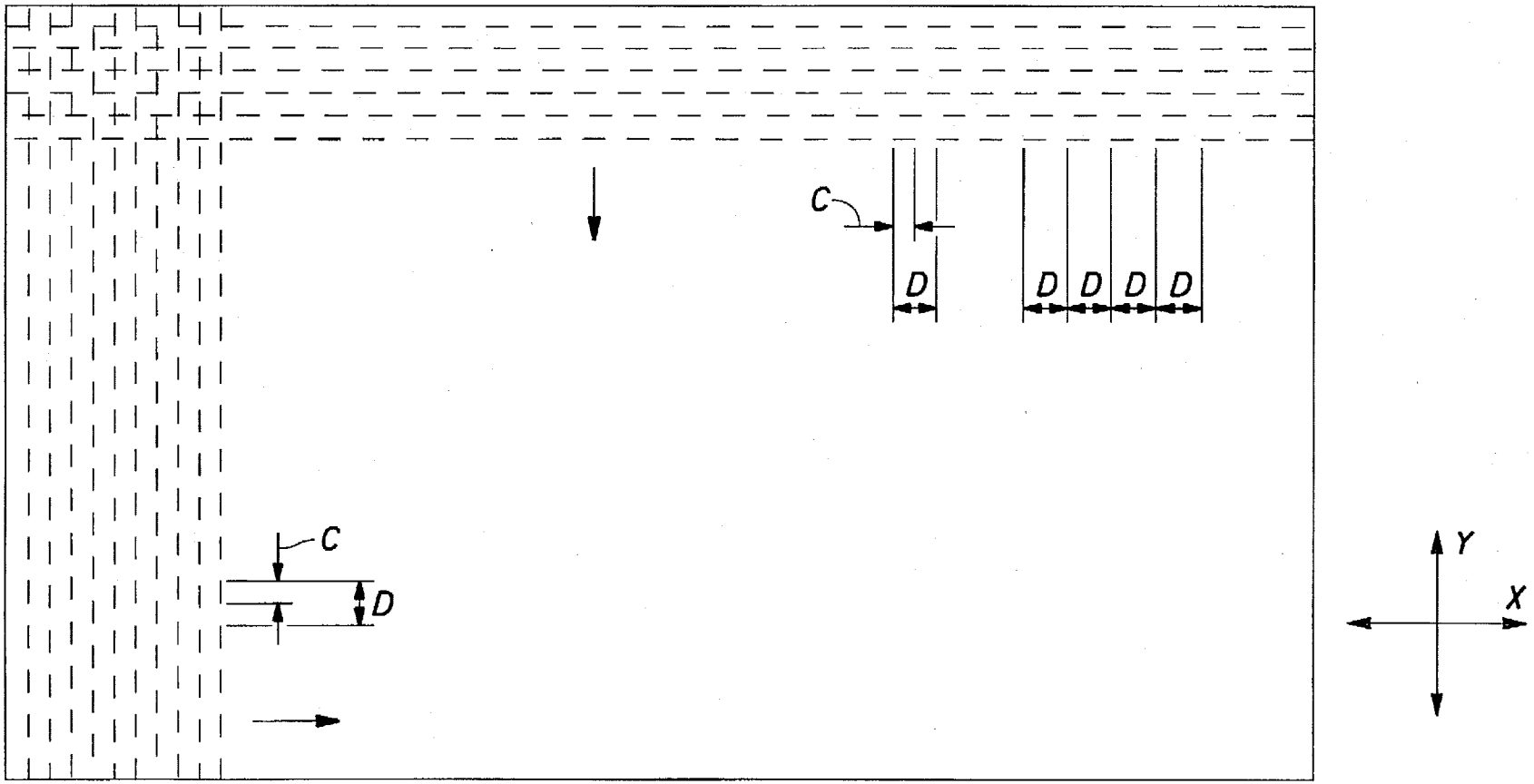
FIG. 6 is the X-Y plan view of one preferred self-registering pattern of lines of weakness.

FIG. 6 illustrates the preferred self-registering pattern of the plurality of lines of weakness. As FIG. 6 shows, the line of weakness 33 of the preferred embodiment comprise a multiplicity of perforations 39 evenly spaced from each other and defining a straight line. The symbol "C" indicates the length of the single perforation 39, and the symbol "D" indicates the length of a repeating unit in the line of perforation 33. As used herein, the term "unit of the line of perforation" means a unit comprised of the single perforation 39 and a space between this single perforation 39 and the next perforation 39. The multiplicity of the units of the line of perforation 33 define the line of perforation 33. In the preferred embodiment, the parallel lines of perforation 33 are spaced from each other about 1 cm (0.3937 inch). For polyolefinic sheets 30 and 40 having a thickness between 1.7 and 2.0 mils and used to form the unitary package 10 comprised of such inner packages 19, 20 as rolls of toilet paper and paper towel wrapped in the wrapper 22, the ratio C/D is between about 0.1 and about 0.5. The preferred ratio C/D is between about 0.1 and about 0.3. The best results were found using the ratio C/D of about 0.2.

One skilled in the art will recognize that the ratio C/D depends upon many factors, such as: distance between parallel lines of perforations 33; strength and thickness of the material from which the sheets 30 and 40 are made; the weight, dimensions and overall geometry of the unitary package 10; the weight and geometry of a single inner package 20; the dimensions and geometry of the area or areas at which the sheets 30 and 40 are joined to the wrapper of the inner packages 19, 20; overall geometry of the pattern of lines of perforation 33; the selected method of carrying the unitary package 10; etc.

Figure 8:
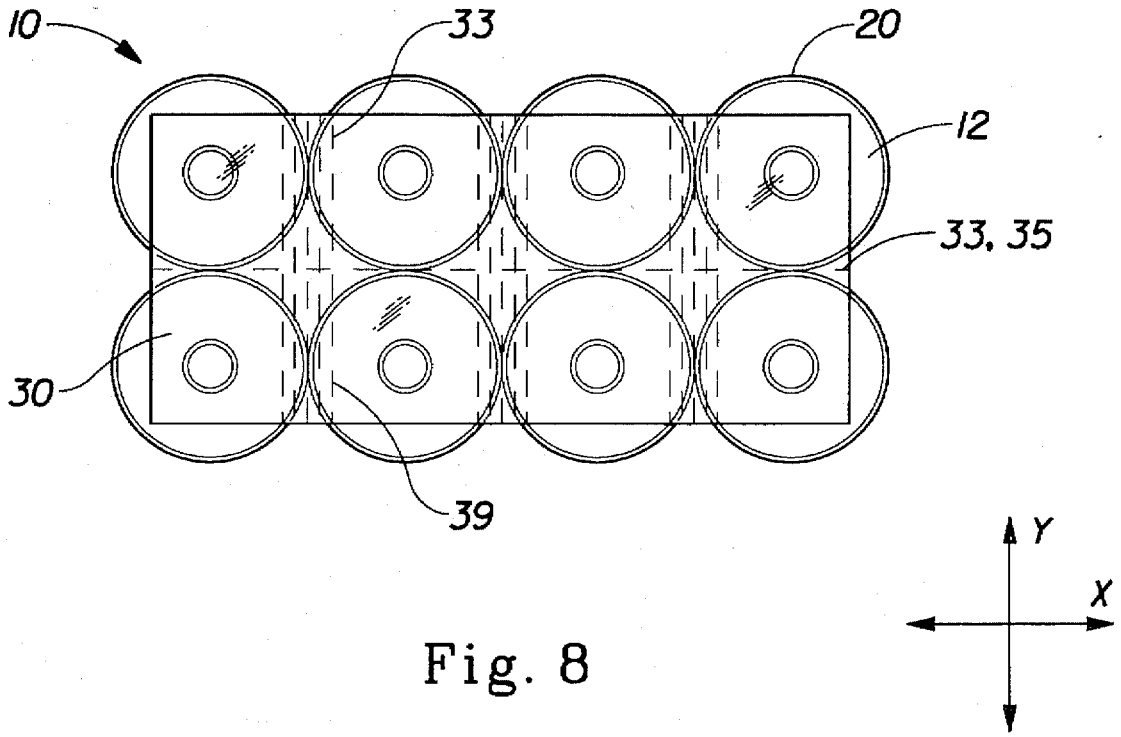
FIG. 8 is the X-Y plan view of the unitary package comprising the first sheet having the pattern of lines of weakness unevenly extending from each other.

While the preferred embodiment of the present invention comprises the pattern 35 of a plurality of lines of perforations 33 running in mutually perpendicular directions and evenly extending from each other, it is to be understood that any pattern 35 of a plurality of lines of weakness 33 which provides the necessary integrity of the unitary package 10 and at the same time allows to disassemble the unitary package 10 along the lines of weakness 33 can be utilized. For example, the pattern of a plurality of lines of Weakness 33 may comprise a concentric array of closed figure polygons or x-shaped cuts, or it may comprise lines of weakness 33 which are not mutually perpendicular. Alternatively, the pattern 35 may comprise a series of lines of weakness 33 spaced from each other. FIG. 8 illustrates a pattern 35 of perforations 39 comprising fifteen parallel lines of weakness 33 running in the Y-direction some of which are not evenly spaced from each other and one line of weakness 33 running in X-direction.

The unitary package 10 may comprise only one sheet of a material 30 interconnecting the inner packages at the first wall 12. This embodiment (not shown) can be satisfactory to hold the inner packages 20 as an integral unit if the unitary package 10 comprises the inner packages 20 having a comparatively large area of the first outside wall 12 and a comparatively small distance between the first outside wall 12 and the second outside wall 14 opposed the first outside wall 12. However, for the unitary packages 10 having a comparatively small area of the first outside wall 12 and a comparatively big distance between the first outside wall 12 and the second outside wall 14, such as inner packages of rolls of paper towel 28, this arrangement may not provide necessary stability. In this case, the unitary package 10 preferably comprises at least one other means for holding the inner packages 20 as an integral unit.

Figure 4:
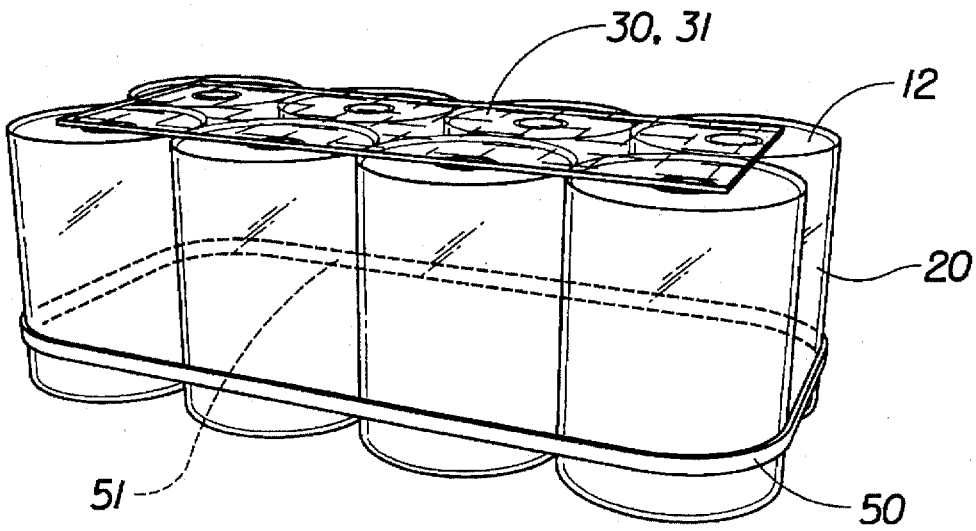
FIG. 4 is a perspective view of the unitary package comprising the first sheet of material interconnecting the inner packages at the first outside wall and the band encircling the inner packages at the second outside wall.

FIG. 4 illustrates the unitary package 10 in which the inner packages are interconnected by the first sheet 30 at the first outside wall 12 and are held together at the second outside wall 14 by a band 50 encircling at least some of the peripherally disposed inner packages 20. Preferably, as shown in FIG. 4, the band 50 encircles each of the peripherally disposed inner packages 20. It is preferred that in this case, the first sheet 30 defines a first plane 31 and the band 50 defines a second plane 51 which is substantially parallel to the first plane 31.

Figure 5:
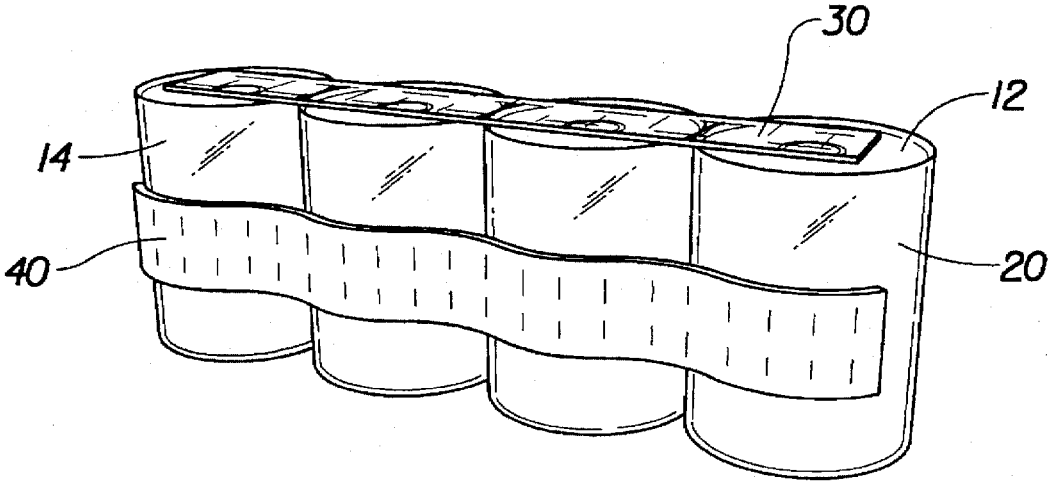
FIG. 5 is a perspective view of the unitary package having the first outside wall and the second outside wall adjacent to each other.

While the preferred embodiment comprises mutually opposed the first outside wall 12 and the second outside wall 14, FIG. 5 shows an embodiment in which the first and second walls 12 and 14 are adjacent to each other. As FIG. 5 shows, each of the inner packages 20 define both outside walls 12 and 14 and are disposed along both walls 12 and 14.

FIGS. 7 and 7*a* represent the embodiment in which the first sheet 30 and the second sheet 40 are integral. That is to say, the first sheet 30 and the second sheet 40 are two integral parts of a single sheet 34. One part of the integral sheet 34 functions as the first sheet 30, and the other part of the integral sheet 34 functions as the second sheet 40.

In the case the unitary package 10 is formed by the inner packages 20 comprising deformable products, such as paper towels and bathroom tissue, the consumer may carry the unitary package 10 by simply inserting his or her hand through the openings between the individual inner packages 20 by slightly deforming the inner packages 20. However, it could be desirable to provide a handle for carrying the unitary package 10. FIGS. 7 and 7*a* also illustrate two exemplary embodiments of the unitary package 10 having handles 60 and 61 respectively. The handle 60 shown in FIG. 7 can be formed by, for example, an extension in the sheets 30 and 40. The handle 61 shown in FIG. 7 can be an integral part of the single sheet 34.

Figure 7B:
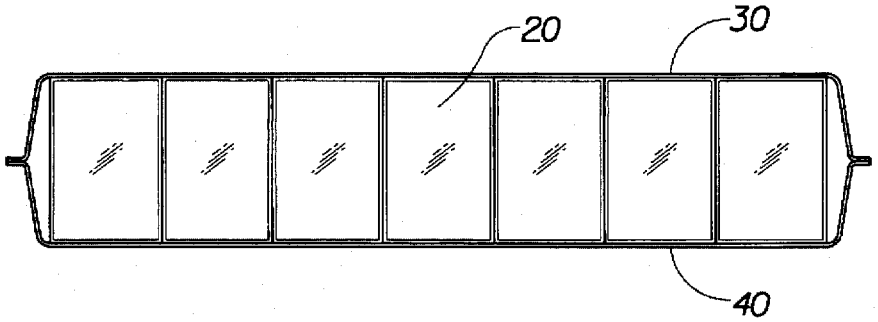
FIG. 7*b* is an embodiment of the unitary package comprising the first and the second sheets of material joined to each other intermediate the first and the second outside walls.

FIG. 7*b* shows another preferred embodiment of the unitary package 10. The unitary package 10 shown in FIG. 7*b* shows the first sheet 30 and the second sheet 40 joined to each other outside the overall dimensions of the unitary package 10 beyond the ends of the first and the second outside walls 12 find 14.

Alternatively, if feasible, the inner packages 19, 20 need not be packaged in an inner wrapper, providing the hygienic requirements are met. In such an embodiment, the first and second sheets 30, 40 may be directly joined to the inner packages 19, 20.

What is claimed is:

1. A unitary package comprising:

a first plurality of inner packages juxtaposed with each other at one or more inner package interfaces, at least two of said inner packages defining and being peripherally disposed along at least a first outside wall and a second outside wall of said unitary package, said peripherally disposed inner packages being wrapped in a second plurality of wrappers, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively;

a first sheet of material juxtaposed with said first outside wall, said first sheet of material spanning at least said maximum X and Y dimensions of said first outside wall and interconnecting said inner packages disposed at said first outside wall by engaging each of said peripherally disposed inner packages, said first sheet of material having a self-registering pattern of a plurality of lines of weakness running in one or more directions, said lines of weakness being spaced from each other by a distance which is less than a width of any one of said inner packages taken in a direction of said distance between said lines of weakness, thereby at least one of said lines of weakness is juxtaposed with at least one of said interfaces of said inner packages, said first sheet of material being separable along said at least one line of weakness such that said unitary package can be carried as an integral unit and disassembled along said at least one line of weakness; and at least one other means for holding said inner packages as an integral unit.

2. A unitary package according to claim 1 wherein said at least one other means comprises a band encircling at least some of said peripherally disposed inner packages.

3. A unitary package according to claim 2 wherein said band encircles all said peripherally disposed inner packages.

4. A unitary package according to claim 3 wherein said first sheet defines a first plane and said band defines a second plane, said first plane and said second plane being substantially parallel.

5. A unitary package according to claim 1 wherein said means for holding said inner packages as an integral unit comprises a second sheet of material juxtaposed with said second outside wall, said second sheet of material spanning at least said maximum X and Y dimensions of said second outside wall and interconnecting said inner packages disposed at said second outside wall by engaging each of said peripherally disposed inner packages, said second sheet of material having a self-registering pattern of a plurality of lines of weakness running in one or more directions, said lines of weakness being spaced from each other by a distance which is less than a width of any one of said inner packages taken in a direction of said distance between said lines of weakness, thereby at least one of said lines of weakness is juxtaposed with at least one of said interfaces of said inner packages, said second sheet of material being separable along said at least one line of weakness such that said unitary package can be carried as an integral unit and disassembled at two said lines of weakness, one said line of weakness being disposed on each of said first and second outside walls.

6. A unitary package according to claim 5 wherein said first outside wall and said second outside wall are mutually opposed.

7. A unitary package comprising:

a first plurality of inner packages juxtaposed with each other at one or more inner package interfaces, at least two of said inner packages defining and being peripherally disposed along at least a first outside wall and a second outside wall of said unitary package, said peripherally disposed inner packages being wrapped in a second plurality of wrappers, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively;

a first sheet of material juxtaposed with said first outside wall, said first sheet of material spanning at least said maximum X and Y dimensions of said first outside wall and interconnecting said inner packages disposed at said first outside wall by engaging each of said peripherally disposed inner packages, said first sheet of material having at least one line of weakness disposed therein and juxtaposed with at least one of said interfaces;

a second sheet of material juxtaposed with said second outside wall, said second sheet of material spanning at least said maximum X and Y dimensions of said second outside wall and interconnecting said inner packages disposed at said second outside wall by engaging each of said peripherally disposed inner packages, said second sheet of material having at least one line of weakness disposed therein and juxtaposed with at least one of said interfaces;

said first sheet of material and said second sheet of material being joined to each other outside the overall dimensions of said unitary package to thereby form a handle.

8. A unitary package comprising:

a first plurality of inner packages juxtaposed with each other at one or more inner package interfaces, at least two of said inner packages defining and being peripherally disposed along at least a first outside wall and second outside wall of said unitary package, said peripherally disposed inner packages being wrapped in a second plurality of wrappers, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively;

a first sheet of material juxtaposed with said first outside wall, said first sheet of material spanning at least said maximum X and Y dimensions of said first outside wall and interconnecting said inner packages disposed at said first outside wall by engaging each of said peripherally disposed inner packages, said first sheet of material having at least one line of weakness disposed therein and juxtaposed with at least one of said interfaces;

a second sheet of material juxtaposed with said second outside wall, said second sheet of material spanning at least said maximum X and Y dimensions of said second outside wall and interconnecting said inner packages disposed at said second outside wall by engaging each of said peripherally disposed inner packages, said second sheet of material having at least one line of weakness disposed therein and juxtaposed with at least one of said interfaces, said first sheet of material and said second sheet of material being joined to each other intermediate said first and second outside walls.

9. A unitary package according to claim 5 wherein said first outside wall is adjacent to said second outside wall.

10. A unitary package comprising:

a first plurality of inner packages juxtaposed with each other at one or more inner package interfaces, at least two of said inner packages defining and being peripherally disposed along at least a first outside wall and a second outside wall of said unitary package, said peripherally disposed inner packages being wrapped in a second plurality of wrappers, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively;

a first sheet of material juxtaposed with said first outside wall, said first sheet of material spanning at least said maximum X and Y dimensions of said first outside wall and interconnecting said inner packages disposed at said first outside wall by engaging each of said peripherally disposed inner packages, said first sheet of material having at least one line of weakness disposed therein and juxtaposed with at least one of said interfaces;

a second sheet of material juxtaposed with said second outside wall, said second sheet of material spanning at least said maximum X and Y dimensions of said second outside wall and interconnecting said inner packages disposed at said second outside wall by engaging each of said peripherally disposed inner packages, said second sheet of material having at least one line of weakness disposed therein and juxtaposed with at least one of said interfaces, said first sheet and said second sheet being integral.

11. A unitary package according to claim 5 wherein at least one of said secondary pluralities of wrappers partially encloses at least one of said inner packages.

12. A unitary package according to claim 11 wherein at least one of said secondary pluralities of wrappers fully encloses at least one of said inner packages.

13. A unitary package according to claim 11 wherein at least one of said secondary pluralities of wrappers partially encloses more than one of said inner packages.

14. A unitary package according to claim 1 wherein said first sheet of material is joined to said first outside wall by heat sealing.

15. A unitary package comprising:

a first plurality of inner packages juxtaposed with each other at one or more inner package interfaces, at least two of said inner packages defining and being peripherally disposed along at least a first outside wall and a second outside wall of said unitary package, said peripherally disposed inner packages being wrapped in a second plurality of wrappers, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively;

a first sheet of material juxtaposed with said first outside wall, said first sheet of material spanning at least said maximum X and Y dimensions of said first outside wall and interconnecting said inner packages disposed at said first outside wall by engaging each of said peripherally disposed inner packages;

a second sheet of material juxtaposed with said second outside wall, said second sheet of material spanning at least said maximum X and Y dimensions of said second outside wall and interconnecting said inner packages disposed at said second outside wall by engaging each of said peripherally disposed inner packages, said first and second sheets of material joined to said first and second walls, respectively, to have at least double thickness walls at regions not coincident with said interfaces, each of said first and second sheets of material having self-registering pattern of a plurality of lines of weakness running in one or more directions, said lines of weakness being spaced from each other by a distance which is less than a width of any one of said inner packages taken in a direction of said distance between said lines of weakens, thereby at least one of said plurality of lines of weakness in said first sheet of material and at least one of said plurality of lines of weakness in said second sheet of material are juxtaposed with at least one of said interfaces, said first and second sheets of material being separable along said at least one line of weakness, whereby said unitary package can be carried as an integral unit and disassembled along at least two said lines of weakness, one said line of weakness being disposed on each of said first and second sheets of material.

16. A unitary package according to claim 15, wherein said first and said second sheets of material are joined to said first and second wall respectfully by heat sealing.

17. A process of forming a unitary package, said process comprising the steps of:

providing a first plurality of inner packages, at least two of said inner packages being wrapped in a second plurality of wrappers;

arranging said first plurality of inner packages such that said inner packages are juxtaposed with each other at one or more interfaces, at least two of said inner packages defining and being peripherally disposed along at least a first outside wall and a second outside wall of said unitary package, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively, said peripherally disposed at least two inner packages being wrapped in said second plurality of wrappers;

providing at least a first sheet of material having self-registering pattern of a plurality of lines of weakness, said lines of weakness being spaced from each other by a distance which is less than a width of any one of said inner packages taken in a direction of said distance between said lines of weakness;

disposing said at least first sheet of material on said first outside wall of said unitary package such that said first sheet of material is juxtaposed with said first outside wall, said first sheet of material spanning at least said maximum X and Y dimensions of said first outside wall, at least one of said plurality of lines of weakness of said self-registering pattern being juxtaposed with at least one of said interfaces;

joining said at least first sheet of material to said first outside wall thereby interconnecting said inner packages disposed at said first outside wall by engaging each of said peripherally disposed inner packages.

18. A process of forming a unitary package according to claim 17 further comprising the steps of:

providing a second sheet of material having self-registering pattern of a plurality of lines of weakness, said lines of weakness being spaced from each other by a distance which is less than a width of any one of said inner packages taken in a direction of said distance between said lines of weakness;

disposing said second sheet of material on said second outside wall of said unitary package such that said second sheet of material is juxtaposed with said second outside wall, said second sheet of material spanning at least said maximum X and Y dimensions of said second outside wall, at least one of said plurality of lines of weakness of said self-registering pattern being juxtaposed with at least one of said interfaces;

joining said second sheet of material to said second outside wall thereby interconnecting said inner packages disposed at said second outside wall by engaging each of said peripherally disposed inner packages.

19. A unitary package comprising:

a first plurality of inner packages juxtaposed with each other at one or more inner package interfaces, at least two of said inner packages defining and being peripherally disposed along at least a first outside wall and a second outside wall of said unitary package, said peripherally disposed inner packages being wrapped in a second plurality of wrappers, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively;

a first sheet of material juxtaposed with said first outside wall, said first sheet of material spanning at least said maximum X and Y dimensions of said first outside wall and interconnecting said inner packages disposed at said first outside wall by engaging each of said peripherally disposed inner packages, said first sheet of material having a self-registering pattern of a plurality of lines of weakness running in one or more directions such that at least one of said plurality of lines of weakness is juxtaposed with at least one of said interfaces of said inner packages and at least one of said plurality of lines of weakness is not located at said interfaces of said inner packages, said first sheet of material being separable along said at least one line of weakness which is juxtaposed with said at least one of said interfaces, whereby said unitary package can be carried as an integral unit and separated along said at least one line of weakness which is juxtaposed with said at least one of said interfaces; and at least one other means for holding said inner packages as an integral unit.

20. A unitary package comprising:

a first plurality of inner packages juxtaposed with each other at one or more inner package interfaces, at least two of said inner packages defining and being peripherally disposed along at least a first outside wall and a second outside wall of said unitary package, said peripherally disposed inner packages being wrapped in a second plurality of wrappers, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively;

a first sheet of material juxtaposed with said first outside wall, said first sheet of material spanning at least said maximum X and Y dimensions of said first outside wall and interconnecting said inner packages disposed at said first outside wall by engaging each of said peripherally disposed inner packages;

a second sheet of material juxtaposed with said second outside wall, said second sheet of material spanning at least said maximum X and Y dimensions of said second outside wall and interconnecting said inner packages disposed at said second outside wall by engaging each of said peripherally disposed inner packages, said first and second sheets of material joined to said first and second walls, respectively, to have at least double thickness walls at regions not coincident with said interfaces, each of said first and second sheets of material having self-registering pattern of a plurality of lines of weakness running in one or more directions such that at least one of said plurality of lines of weakness is juxtaposed with at least one of said interfaces of said inner packages and at least one of said plurality of lines of weakness is not located at said interfaces of said inner packages, each of said first and second sheets of material being separable along said at least one line of weakness which is juxtaposed with said at least one interface, whereby said unitary package can be carried as an integral unit and disassembled along at least two said lines of weakness which are juxtaposed with said at least one interface, each of said two lines of weakness being disposed on each of said first and second sheets of material, respectively.

21. A process of forming a unitary package, said process comprising the steps of:

providing a first plurality of inner packages, at least two of said inner packages being wrapped in a second plurality of wrappers;

arranging said first plurality of inner packages such that said inner packages are juxtaposed with each other at one or more interfaces, at least two of said inner packages defining and being peripherally disposed along at least a first outside wall and a second outside wall of said unitary package, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively, said peripherally disposed at least two inner packages being wrapped in said second plurality of wrappers;

providing at least a first sheet of material having a self-registering pattern of a plurality of lines of weakness comprising an array of a series of lines of weakness running in one or more directions;

disposing said at least first sheet of material on said first outside wall of said unitary package such that said first sheet of material is juxtaposed with said first outside wall, said first sheet of material spanning at least said maximum X and Y dimensions of said first outside wall, at least one of said plurality of lines of weakness being juxtaposed with at least one of said interfaces of said inner packages and at least one of said plurality of lines of weakness being not located at said interfaces of said inner packages;

joining said at least first sheet of material to said first outside wall thereby interconnecting said inner packages disposed at said first outside wall by engaging each of said peripherally disposed inner packages.

22. A process of forming a unitary package, said process comprising the steps of:

providing a first plurality of inner packages, at least two of said inner packages being wrapped in a second plurality of wrappers;

arranging said first plurality of inner packages such that said inner packages are juxtaposed with each other at one or more interfaces, at least two of said inner packages defining and being peripherally disposed along at least a first outside wall and a second outside wall of said unitary package, each of said first and second outside walls having mutually perpendicular maximum X and Y dimensions, whereby said maximum X and Y dimensions span the distance from at least a portion of inner packages spaced furthest apart in the mutually perpendicular X and Y directions, respectively, said peripherally disposed at least two inner packages being wrapped in said second plurality of wrappers;

providing a first sheet of material and a second sheet of material, each of said first and second sheets of material having a self-registering pattern of a plurality of lines of weakness comprising an array of a series of lines of weakness running in one or more directions;

disposing said first and second sheets of material on said first and second outside walls of said unitary package, respectively, such that said first sheet of material is juxtaposed with said first outside wall and said second sheet of material is juxtaposed with said second outside wall, said first and second sheets of material spanning at least said maximum X and Y dimensions of said first and second outside walls, respectively, at least one of said plurality of lines of weakness of each of said first and second sheets of material being juxtaposed with at least one of said interfaces of said inner packages and at least one of said plurality of lines of weakness of each of said first and second sheets of material being not located at said interfaces of said inner packages, each of said first and second sheets of material being separable along said at least one line of weakness which is juxtaposed with said at least one interface;

joining said first and second sheets of material to said first and second outside walls of said unitary package, respectively, thereby interconnecting said inner packages disposed at said first and second outside walls by engaging each of said peripherally disposed inner packages.

* * * * *

UNITED STATES PATENT AND TRADEMARK OFFICE

CERTIFICATE OF CORRECTION

PATENT NO. : 5,685,428

DATED : November 11, 1997

INVENTOR(S) : DENNIS MICHAEL HERBERS ET AL.

It is certified that error appears in the above-identified patent and that said Letters Patent is hereby corrected as shown below:

Column 5, line 17, "roils" should read – rolls –.

Column 5, line 33, "Walls" should read – walls –.

Column 5, line 35, "example,." should read – example, –.

Column 5, line 51, "Herein," should read – herein, –.

Column 6, line 26, "find" should read – and –.

Column 6, line 30, ".least" should read – least –.

Column 9, line 54, "find" should read – and –.

Column 12, line 6, delete "a".

Signed and Sealed this

Fourteenth Day of April, 1998

Bruce Lehman

*Attest:*

BRUCE LEHMAN

*Attesting Officer*

*Commissioner of Patents and Trademarks*